US005194739A

United States Patent [19]

Sato et al.

[11] Patent Number: 5,194,739

[45] Date of Patent: Mar. 16, 1993

[54] LIQUID METAL ION SOURCE

[75] Inventors: Keiji Sato; Yoshie Kitamura; Hiroyuki Suzuki, all of Tokyo, Japan

[73] Assignee: Seiko Instruments Inc., Tokyo, Japan

[21] Appl. No.: 854,710

[22] Filed: Mar. 20, 1992

[30] Foreign Application Priority Data

Mar. 22, 1991 [JP] Japan ..... 3-58996

[51] Int. Cl.[5] ..... H01J 27/00

[52] U.S. Cl. ..... 250/423 R; 250/423 F; 315/111.81

[58] Field of Search ..... 250/423 R, 423 F, 424; 315/111.81, 111.91

[56] References Cited

U.S. PATENT DOCUMENTS 4,687,938 8/1987 Tamura et al. ..... 250/423 R 4,994,711 2/1991 Matossian ..... 250/423 R

*Primary Examiner*—Jack I. Berman

*Assistant Examiner*—Kiet T. Nguyen

*Attorney, Agent, or Firm*—Spensley Horn Jubas & Lubitz

[57] ABSTRACT

A liquid metal ion source which can produce cesium ions stably for a long time in the form of a beam focussed to a micro-spot. The liquid metal ion source is composed of a reservoir containing a liquid metal, and a needle type emitter passing through the reservoir and having a sharp tip end which protrudes from the reservoir, the liquid metal being composed primarily of a cesium compound containing 0.3-20 atom % of oxygen.

6 Claims, 1 Drawing Sheet

LIQUID METAL ION SOURCE

BACKGROUND OF THE INVENTION

The present invention relates to a liquid metal ion source of the type utilized in a secondary ion mass spectrometer, a focused ion beam processing device, etc., for generating a converged ion beam having a high intensity and a micro-spot diameter.

For example, Japanese utility model laid-open application No. 63-101452 discloses a conventional liquid metal ion source of the type which ionizes a liquid metal by means of a high electric field. FIG. 1 is a simplified sectional view of such a source.

In this source, a liquid metal 1 is contained and held in a reservoir 2. An emitter 3 of the needle type has a sharp tip end which protrudes from the reservoir 2. Typically, the needle type emitter 3 is composed of tungsten (W). Further, at least a part of the needle type emitter 3 is immersed in the liquid metal 1. A heater 4 is disposed around the reservoir 2 so as to heat and melt the metal within the reservoir 2 to form the liquid metal 1. The liquid metal 1 is supplied to the tip end of the needle type emitter 3 due to the wettability of emitter 3. The heater 4 is covered by a reflector 5 to reflect thermal radiation to improve heat efficiency.

The liquid metal 1 within the reservoir 2 flows along the surface of the needle type emitter 3 due to its wettability to reach the sharp tip end of emitter 3.

An extracting electrode 6 is provided in opposed relation to the sharp tip end of the needle type emitter 3 such that an ion extraction voltage of the order of 2-10 kV is applied between the emitter 3 and the extracting electrode 6. By this extraction voltage, liquid metal ions are emitted from the tip end of the needle type emitter 3.

In an ion source with such a needle type emitter, since the liquid metal 1 flows along the emitter surface to feed the tip end of the emitter 3, the wettability of the liquid metal 1 with respect to emitter 3 is a significant factor. Namely, if the liquid metal 1 has poor wettability with respect to the needle type emitter 3, liquid metal ions are not generated efficiently. Further, in case that the liquid metal has a high vapor pressure at the temperature of the liquid metal ion emission, the liquid metal 1 is vaporized considerably at the tip end portion of the emitter 3 and will then be deposited on an insulating portion of the ion source device, thereby practically disadvantageously causing insulation failure and interior contamination.

However, the origin of emission of ions is confined within the sharp tip end area of the emitter 3 so that there can be obtained an ion beam which is converged to a tiny spot diameter.

There is another type of emitter structure as shown in FIG. 4 where the emitter is of a capillary type. The capillary type emitter **3*a* is formed as a minute tube at the bottom of reservoir 2 such that the liquid metal 1 flows through the tube to thereby emit ions from the tip end of the capillary type emitter 3*a*. In this structure, even if the liquid metal 1 has a relatively poor wettability to tube 3*a*, the liquid metal 1 can be fed to the tip end of the capillary type emitter 3*a***. Therefore, this structure can be applied to liquid metals having a relatively poor wettability.

Further, since the capillary tube is almost sealed except at the tip end of the emitter **3*a***, there can be utilized a metal material having a relatively high vapor pressure. However, as the level of metal in the ion emission source descends progressively, the beam diameter varies. However, depending on the changes of the portion of the ion emission source where the ionization occurs, the beam drifts.

In a secondary ion mass spectrometer (SIMS), an ion bun utilizes cesium (Cs) as an ion species. The use of the cesium ions as the primary ion species can significantly improve the negative secondary ion yield of negative elements such as carbon (C), oxygen (O), Fluorine (F), chlorine (Cl), sulfur (S) and selenium (Se). Therefore, cesium is suitable for the ion species of the ion gun in such secondary ion mass spectrometer.

The cesium metal ion source can improve the secondary ion yield when analyzing negative elements by a SIMS as mentioned above, hence there can be obtained a spectrometer having a very high sensitivity. However, liquid cesium does not have a good wettability for a material of the needle type emitter such as tungsten, hence liquid cesium cannot be fed smoothly to the tip end of the needle type emitter from the reservoir in the ion source device. Further, cesium metal has a high vapor pressure which may cause spark or short failures due to deposition of cesium on an insulating portion of the ion source device as a result of evaporation of the cesium. Namely, there has not been provided a practical liquid cesium metal ion source having a needle type emitter which could operate stably for a long time in a high vacuum condition for performance of highly sensitive analyses.

In view of this, conventionally, the capillary type emitter has been utilized practically in liquid cesium metal ion sources. As described before, the capillary type emitter has the drawbacks that the beam spot diameter varies gradually and the ion beam can not be converged to a tiny spot diameter because the ions are emitted from a relatively wide area.

SUMMARY OF THE INVENTION

Therefore, an object of the present invention is to improve the wettability of cesium relative to a needle type emitter and further to lower the vapor pressure of cesium in order to provide a liquid metal ion source utilizing cesium as the ion species and having a needle type emitter which can operate stably for a long time.

In order to solve the above noted problem, the inventive liquid metal ion source of the needle type emitter utilizes a liquid metal composition of cesium containing 0.3-20 atom % of oxygen.

A cesium composition according to the invention may contain oxygen or relatively oxygen deficient cesium oxide, effective to improve the wettability for tungsten material of the needle type emitter in the liquid metal ion source so that cesium atoms can be continuously fed to the tip end of the needle type emitter. Further, the cesium composition has a melting point which is lower than that of pure cesium metal (28.6° C.), thereby making possible ion emission at a relatively low temperature as compared to pure cesium metal to thereby suppress the vapor pressure.

Namely, the invention makes possible a liquid metal ion source having a needle type emitter which operates stably for a long duration while using cesium as the ion species.

DESCRIPTION OF THE PREFERRED EMBODIMENTS

Hereinafter, embodiments of the invention will be described in conjunction with the drawings.

EMBODIMENT 1

Figure 1:
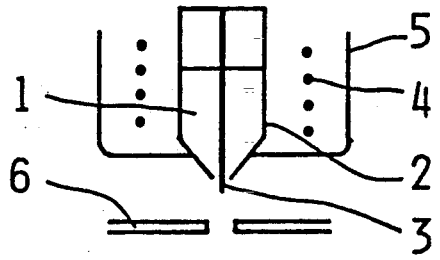
FIG. 1 PRIOR ART
FIG. 1 is a simplified sectional view showing one embodiment of a basically conventional metal ion source which can be used in the practice of the present invention.

FIG. 1 shows one embodiment of the liquid metal ion source according to the invention. This embodiment is structurally similar to the conventional liquid metal ion source of the type having a needle emitter, and therefore further detailed description of the structure will be omitted.

The liquid metal 1 according to the invention was prepared in the form of a cesium composition which contains a small amount of oxygen (about 0.3 atom %) and which has a melting point of 27.5° C. The cesium composition was stored in the reservoir 2 of the ion source, and was heated to 35 ° C. by the heater 4 so that the needle type emitter 3 was wetted by the liquid metal 1. Further, an ion extraction voltage of the order of 5 kV was applied between the emitter 3 and the extracting electrode 6 so that ions were emitted from the tip end of the emitter 3. In this case, although the needle type emitter 3 was on occasion caused to be partly free of the liquid cesium film, so that as a result ion emission was interrupted, ions were generally emitted smoothly and continuously.

For comparison purposes, commercially available pure cesium metal containing no oxygen and having a melting point of 28.6° C. was utilized as the liquid metal 1 so as to carry out emission of the cesium ions in the same manner as for Embodiment 1. Ion emission occurred only once every three trials. Ion emission was immediately discontinued even when the ion emission had been initiated. This failure was due to poor wettability of the liquid cesium for the material (tungsten) of the needle type emitter 3. The liquid cesium was not able to feed the tip end of the emitter 3 continuously.

In order to enhance ion emission of pure liquid cesium, the liquid metal 1 was heated to 100° C., but spark failure occurred within the liquid metal ion source in this case.

Returning to Embodiment 1, the alloy of cesium and oxygen may contain, more or less, 0.3 atom % of oxygen when the alloy has a melting point of 27.5° C. Generally, the melting point is easily and accurately measured as compared to the measurement of the oxygen content. Therefore, it is more practical to determine the melting point rather than to determine the precise oxygen content.

EMBODIMENT 2

In the same construction of the liquid metal ion source as for Embodiment 1, the liquid metal 1 was prepared in the form of a cesium composition containing about 19.5 atom % of oxygen, which had a melting point of about 80° C. The liquid metal 1 was heated to 90° C. and other conditions were set similar to Embodiment 1. In this example, ions were continuously generated without interruption of the ion emission.

Further, the temperature of the liquid metal 1 was raised to 100° C., but spark failure and short circuit failure frequently occurred in the liquid metal ion source device. Accordingly, it is critical to limit the temperature, and the melting point, of the liquid metal 1 below 100° C.

Mass spectrography was conducted to analyze species of the emitted ions, which proved that oxygen ions were generated concurrently with the cesium ions. This showed that the inventive liquid metal ion source device could be used as an oxygen ion source well as a cesium ion source. This is a significant feature of the present invention.

EMBODIMENT 3

Figure 2:
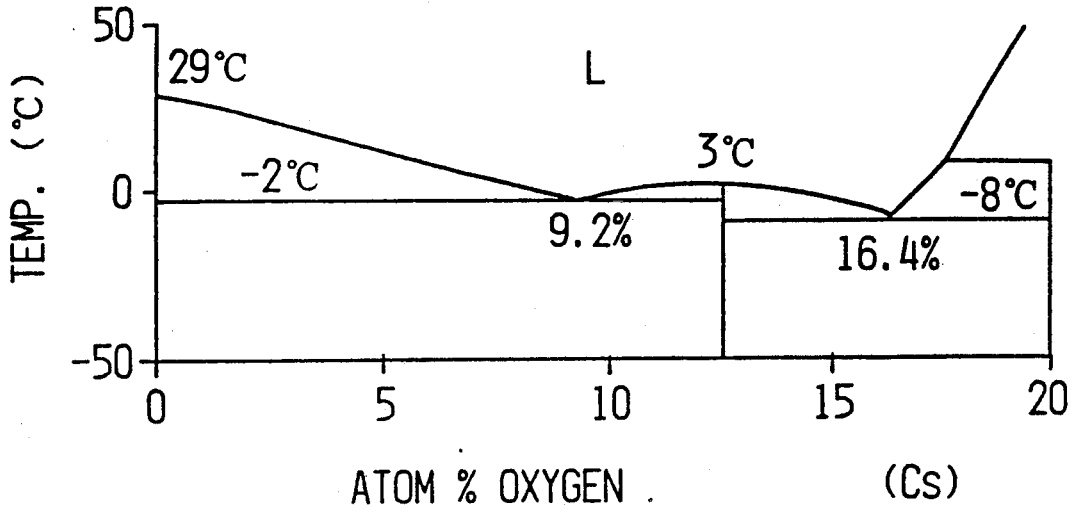
FIG. 2 is a partial constitution diagram of cesium and oxygen.

This example is directed to other cesium compositions containing different proportions of oxygen. FIG. 2 shows a partial constitution diagram of cesium and oxygen. Relatively oxygen deficient cesium oxides were used, including $Cs_7O$ and $Cs_4O$. As understood, the eutectic phase of these oxides and cesium metal contains 5–18 atom % of oxygen and has a melting point below 10° C. Further, Table 1, below, shows the relation between the oxygen content of the cesium composition and the vapor pressure just around the melting point.

TABLE 1

| Sample No. | oxygen content atom % | temp. °C. | Vapor pressure mmHg |
|---|---|---|---|
| 1 | 0 | 40 | $7 \times 10^{-6}$ |
| 2 | 5 | 10 | $3 \times 10^{-7}$ |
| 3 | 9 | 0 | $9 \times 10^{-8}$ |
| 4 | 14 | 14 | $1 \times 10^{-7}$ |
| 5 | 18 | 18 | $4 \times 10^{-7}$ |

As understood from Table 1, the vapor pressure decreases as the melting point decreases. In addition, the cesium oxide has a certain electroconductivity in this composition range.

Figure 3:
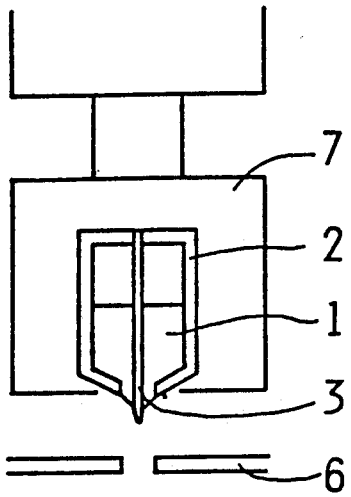
FIG. 3 is a sectional view showing another embodiment of a metal ion source which can be used in the practice of the present invention.
Figure 4:
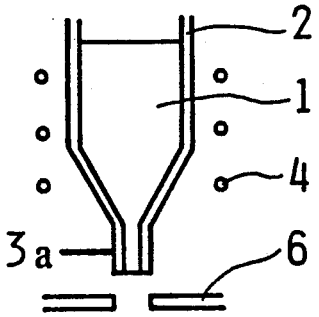
FIG. 4 PRIOR ART
FIG. 4 is a sectional view showing a conventional metal ion source having a capillary type emitter.

FIG. 3 is a sectional view showing another liquid metal ion source structure which may be employed in the practice of the invention.

The liquid metal 1 composed of a cesium composition containing oxygen is stored in the reservoir 2 composed of molybdenum, and is fed to the needle type emitter 3 composed of tungsten. The reservoir 2 is covered by a cooler 7 which effects cooling of the liquid metal 1 and temperature control. The extracting electrode 6 is provided in opposed relation to the needle type emitter 3.

In the liquid metal ion source having the FIG. 3 construction, various cesium compositions indicated by sample numbers 2–5 listed in Table 1 were tested in this example of the invention. Each sample of the liquid metal 1 was heated to the corresponding temperature listed in the third column of Table 1 to carry out emission of ions, while the extraction voltage was set to 5 kV.

In the case of each of sample numbers 2–5, ions were emitted from the tip end of the needle type emitter 3 continuously for a long time of over 100 hours, while the ion current level was kept stable. Particularly, sample numbers 3 and 4 showed a long emission duration.

Also in this example, the generated ion species were analyzed by a mass spectrometer, showing that oxygen ions were emitted in addition to cesium ions.

In addition, similar results were obtained when using tantalum, platinum, a platinum alloy, or stainless steel as the material of the reservoir 2 and the needle type emitter 3 in place of molybdenum and tungsten, respectively.

According to the invention, as described above, the cesium composition containing oxygen is utilized as the liquid metal of the ion source so as to improve wettability of cesium for the needle type emitter so that the liquid metal can be continuously fed to the needle tip end. Further, cesium compositions containing 5–18 atom % of oxygen have a melting point below 10° C. so that the liquid metal ion source can be operated at a lower temperature than if pure cesium metal were used. By lowering the temperature of the liquid metal, the amount of evaporation of the liquid metal is significantly reduced, thereby avoiding insulation failure due to deposition of the liquid metal on an insulation portion of the ion source device and preventing contamination within the device.

Accordingly, there can be obtained a liquid metal ion source of the needle emitter type featuring stable operation for a long time using cesium as the ion species. In addition, the device can be utilized also as an oxygen ion source.

This application relates to subject matter disclosed in Japanese Application number 3/58996, filed on Mar. 22, 1992, the disclosure of which is incorporated herein by reference.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A liquid metal ion source comprising a reservoir, a liquid metal contained in the reservoir, and an emitter of a needle type immersed at least partly in the liquid metal within the reservoir and provided with a sharp tip end which protrudes from the reservoir, wherein said liquid metal is composed of cesium and oxygen.

2. A liquid metal ion source as defined in claim 1 wherein said liquid metal contains 0.3–20 atom % oxygen.

3. A liquid metal ion source as defined in claim 2 wherein the balance of said liquid metal is composed substantially entirely of cesium.

4. A liquid metal ion source as defined in claim 2 wherein said liquid metal contains 5–18 atom % oxygen.

5. A liquid metal ion source as defined in claim 4 wherein the balance of said liquid metal is composed substantially entirely of cesium.

6. A liquid metal ion source as defined in claim 1 further comprising a cooler for cooling said liquid metal below room temperature.

* * * * *